US005295191A

United States Patent [19]

Van Vroenhoven

[11] Patent Number: 5,295,191

[45] Date of Patent: Mar. 15, 1994

[54] HEARING AID INTENDED FOR BEING MOUNTED WITHIN THE EAR CANAL

[75] Inventor: Petrus A. W. H. Van Vroenhoven, Eindhoven, Netherlands

[73] Assignee: U.S. Philips Corporation, New York, N.Y.

[21] Appl. No.: 893,876

[22] Filed: Jun. 5, 1992

[30] Foreign Application Priority Data

Jun. 7, 1991 [EP] European Pat. Off. ..... 91201411.5

[51] Int. Cl.[5] ..... H04R 25/00

[52] U.S. Cl. ..... 381/68.6; 381/68

[58] Field of Search ..... 381/68.6, 68, 69, 68.1

[56] References Cited

U.S. PATENT DOCUMENTS 4,756,312 7/1988 Epley ..... 381/68.6

5,003,608 3/1991 Carlson ..... 381/68

5,012,520 4/1991 Steeger ..... 381/68

*Primary Examiner*—Jin F. Ng

*Assistant Examiner*—Sinh Tran

*Attorney, Agent, or Firm*—Bernard Franzblau

[57] ABSTRACT

An in-the-ear canal hearing aid comprises a microphone, an amplifier, an electromechanical transducer, for example in the form of a telephone, and an infrared detector. The hearing aid also includes an elongated extraction element for extracting the hearing aid from the ear canal. The extraction element is in the form of an optical conductor for conducting infrared radiation. One end of the optical conductor is mechanically attached to the hearing aid housing in a manner such that the end of the conductor is optically coupled to the infrared detector. As a result, the extraction element is a dual function device in which its second function is to conduct the infrared radiation to the infrared detector of the hearing aid.

7 Claims, 1 Drawing Sheet

HEARING AID INTENDED FOR BEING MOUNTED WITHIN THE EAR CANAL

BACKGROUND OF THE INVENTION

1. Field of the Invention

This invention relates to a hearing aid intended to be mounted within an ear canal, comprising a microphone, an amplifier and an electromechanical transducer, for example, a telephone, accommodated in a housing, and including an extraction means for extracting the hearing aid from the ear canal, the input to the microphone being acoustically coupled to a sound entrance in the housing.

2. Description of the Related Art

Such a hearing aid is known from U.S. Pat. No. 4,756,312. A contact hearing aid is discussed there, in which the electromechanical transducer is in the form of a piezoelectric element generating vibrations which are transferred directly to the tympanic membrane. For this purpose, the hearing aid is to be mounted deep within the ear canal. It is more customary for the transducer to have the form of a telephone (loudspeaker) with which acoustic signals are generated which hit the tympanic membrane. In this embodiment too there are hearing aids which are to be mounted deep within the ear canal. For extracting such hearing aids from the ear canal, the hearing aids comprise extraction means.

The extraction means in the prior art hearing aid is in the form of a rod of ferromagnetic material which at one end cooperates with a magnet and the other end is capable of cooperating with a magnetic ring attached to the housing of the hearing aid. The magnet may be disposed in two positions relative to the rod. In one position of the magnet the hearing aid may be extracted from the ear canal by means of a magnetic force exerted on the ring of the hearing aid by the other end of the rod. In the other position of the magnet the rod can, prior to the hearing aid being extracted, be inserted into the ear canal without a force being exerted on the hearing aid by the rod. The prior-art hearing aid thus has the drawback of requiring a separate accessory for extracting the hearing aid. It is known to use, in lieu of a separate accessory, a component which is mechanically, hinged or not, coupled to the housing.

SUMMARY OF THE INVENTION

It is an object of the invention to propose a different type of extraction means so that a separate accessory is not required either.

The hearing aid according to the invention is thereto characterized, in that the hearing aid comprises a detector accommodated in the housing, this detector being arranged for receiving infrared signals, for converting the infrared signals into electric signals and for supplying these electric signals at an output, and including a signal processing means with an input coupled to the output of the detector, for processing the electric signals supplied by the detector, in that the extraction means is in the form of an elongated radiation conductive element for conducting the infrared signals, in that an end of the radiation conductive element is mechanically coupled to the housing in the place of the detector, so that the detector is optically coupled to said end of the radiation conductive element.

The measure according to the invention is based on the recognition that with respect to the extraction means a choice is to be made so that further problems that may occur with a hearing aid can be remedied simultaneously.

Hearing aids per se are known comprising an infrared detector for receiving infrared signals. They may be, for example, infrared remote control signals for the hearing aid. However, wireless transmission of audio signals to the hearing aid may also be concerned. If such a hearing aid is arranged as an in-the-ear canal apparatus, which is to be worn deep within the ear canal, the following problem may occur. Since the hearing aid is mounted deep within the ear canal, it is possible that there is no "visual contact" with the surroundings outside the ear canal as a result of the shape of the ear canal. The infrared transmission to the detector may therefore be seriously disturbed. By implementing the measure according to the invention the extraction means is arranged in the form of the elongated radiation conductive element, so that it likewise serves as an optical conductor for the external infrared signals to the detector. Since the other end of the radiation conductive element protrudes from the ear canal, a better reception of the infrared signals in the detector is thus realised by means of the external infrared signals being conducted via the radiation conductive element to the detector. The radiation conductive element thus has a twofold object. On the one hand the element serves as an extraction mechanism and on the other hand the element serves as a conductor for the infrared signals.

The other end of the radiation conductive element preferably comprises an optical converging means. This may realise an enhancement of the infrared signal reception. The optical converging means may also be used as a gripping means, as required, so that the hearing aid may be extracted from the ear canal in a simple manner.

BRIEF DESCRIPTION OF THE DRAWINGS

The invention will be further explained in the following description of the drawings with reference to an exemplary embodiment, in which.

DESCRIPTION OF THE PREFERRED EMBODIMENTS

Figure 1:
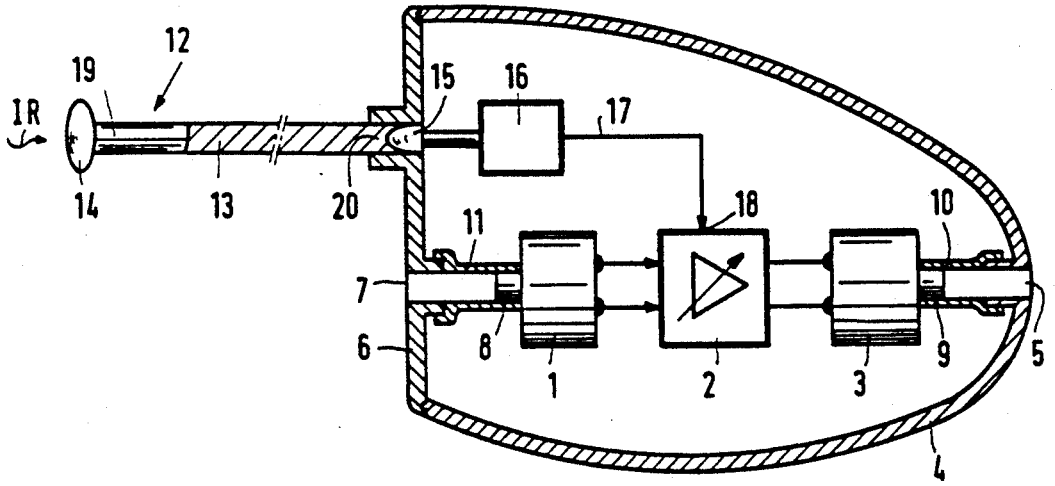
FIG. 1 shows a first exemplary embodiment.

FIG. 1 shows in a diagram a hearing aid which can be mounted within the ear canal, a so-called in-the-ear canal hearing aid. The hearing aid comprises a microphone 1, an amplifier 2 and an electromechanical transducer 3 which are all accommodated in a housing 4. The housing 4 has an external shape adapted to the internal shape of the ear canal of the user of the hearing aid. The transducer 3 is a telephone (loudspeaker) in the present example. The hearing aid is inserted into the ear canal in such a way that the sound exit 5 of the hearing aid is directed towards the tympanic membrane. The sound output 9 of the telephone 3 is acoustically coupled to the sound exit 5 by way of a tube 10. The housing 4 is shut off by a cover 6 on the side remote from the tympanic membrane. In this cover there is a sound entrance 7 which is acoustically coupled to the sound input 8 of the microphone 1 by means of an acoustic tube 11. The cover 6 may comprise still more components of the hearing aid, such as a volume control, and it may have an opening for inserting a battery, which opening may be closed by a button (not shown).

The hearing aid further includes a detector 15 in the form of an infrared receiving diode for receiving infrared signals IR. In the exemplary embodiment shown in FIG. 1 they are infrared signals in the form of control signals for an infrared hearing aid remote control. The detector converts the received infrared signals into electric signals. These electric signals are supplied to a signal processing unit 16 which derives a control signal from the detected signals. This may be a control signal for controlling the gain factor of the amplifier 2. For that purpose the control signal is fed to a control signal input 18 of the amplifier 2 by way of the line 17.

The hearing aid further includes an extraction means 12. The extraction means is in the form of an elongated element 13. The end 19 of the elongated element 13 may have a thickening 14 serving as a gripping means. The end 20 of the elongated element 13 is mechanically attached to the cover 6 of the housing 4. The element 13 is a radiator conductive element which is internally reflective, so that the infrared radiation, incident in the longitudinal direction of the element at the end 19, is transferred to the other end 20. The end 20 is furthermore optically coupled to the detector 15. External infrared radiation incident at the end 19 is thus transported to the detector via the conductor 13 so that the detector 15 can detect this infrared radiation.

The element 13 has such a length that the user can pull the hearing aid out by the thickening at the end 19 if the hearing aid is embedded in the ear canal.

The element 13 thus not only functions as an extraction means but also as a means for conducting the infrared radiation to the detector 15.

The element 13 may be constructed in the form of an optical fibre for which all kinds of materials are available. The element 13 may be made of a rigid material or a flexible material.

The thickening 14 may also serve as a radiation converging means, as required, realising an enhancement of the infrared radiation to be conducted by the element 13. Radiation converging means at the end of fibres are known per se and may be provided in the form of a lens. All the measures known with respect to optical fibre techniques which may be of use in the present application could be applied here too.

Figure 2:
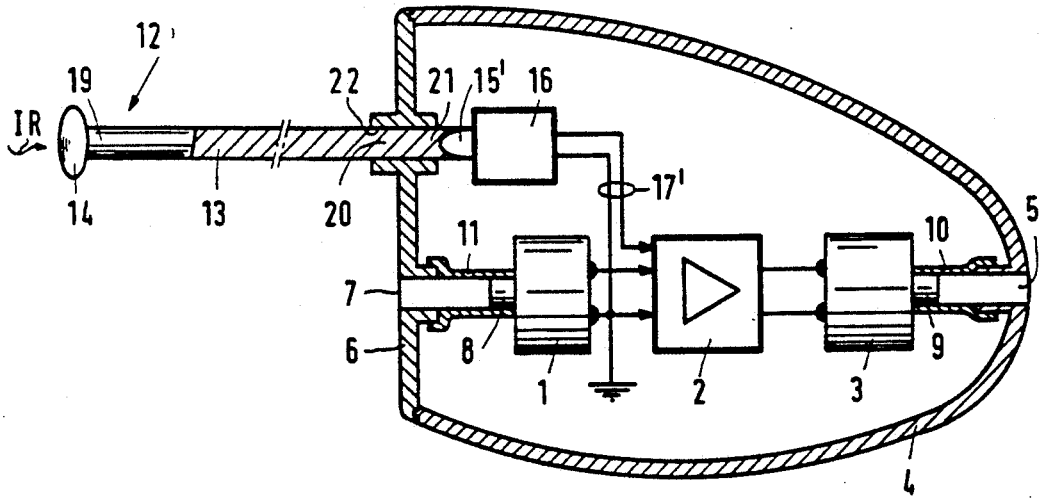
FIG. 2 shows a second exemplary embodiment.

FIG. 2 shows a slightly different exemplary embodiment in which the construction of the infrared detector is different and in which the infrared transmission is the transmission of a second audio signal to the hearing aid. The infrared receiving diode 15' is here accommodated further into the inside of the hearing aid. The infrared detector in this exemplary embodiment is formed by a radiation conductor 21 and a diode 15'. The radiation conductor 21 realises an optical coupling between the opening 22 in the cover 6 and the diode 15'. The radiation conductor 21 and the radiation conductor 13 form one whole.

The signal processing unit 16 derives an audio signal from the signal detected by the diode 15', which audio signal is fed to a second input of the amplifier 2 via the line 17'. In the amplifier 2 a selection may then be made which of the two audio signals, either from the microphone 1 or from the unit 16, is amplified and applied to the telephone. Alternatively, it is possible for the two audio signals to have a relationship to each other so that they can be added together in the amplifier 2, so that a better audio sensation is obtained.

I claim:

1. A hearing aid to be mounted within an ear canal, comprising: a microphone, an amplifier and an electromechanical transducer accommodated in a housing, an extraction means for extracting the hearing aid from the ear canal, the input to the microphone being acoustically coupled to a sound entrance in the housing, the hearing aid further comprising a detector accommodated in the housing, said detector being arranged to receive infrared signals and for converting the infrared signals into electric signals and for supplying said electric signals to an output, and a signal processing means with an input coupled to the output of the detector for processing the electric signals supplied by the detector, wherein the extraction means comprises an elongated radiation conductive element for conducting the infrared signals, and an end of the radiation conductive element is mechanically coupled to the housing in the area of the detector so that the detector is optically coupled to said end of the radiator conductive element.

2. A hearing aid as claimed in claim 1, wherein the other end of the radiation conductive element comprises a gripping means.

3. A hearing aid as claimed in claim 2, wherein the other end of the radiation conductive element comprises optical converging means.

4. A hearing aid as claimed in claim 3, wherein the optical converging means also serve as the gripping means.

5. A hearing aid as claimed in claim 1 wherein the radiation conductive element comprises an internally reflecting optical fibre.

6. A hearing aid as claimed in claim 1, wherein the other end of the radiation conductive element comprises optical converging means.

7. A hearing aid as claimed in claim 6, wherein the optical converging means also serve as a gripping means.

* * * * *